United States Patent [19]

Scalzo

[11] 4,433,596

[45] Feb. 28, 1984

[54] WABBLER PLATE ENGINE MECHANISMS

[76] Inventor: Joseph Scalzo, 26, Florence Ave., Kew, Melbourne, Victoria 3101 Australia

[21] Appl. No.: 243,411

[22] Filed: Mar. 13, 1981

[30] Foreign Application Priority Data

Mar. 11, 1980 [GB] United Kingdom ..... 8008264

[51] Int. Cl.[3] ..... F16H 35/08; F16H 1/28; F16H 23/00; F01B 3/00

[52] U.S. Cl. ..... 74/839; 74/60; 74/800; 91/505; 91/506; 92/12.2; 123/58 B; 417/222; 417/269

[58] Field of Search ..... 74/60, 800, 839; 91/505, 506; 92/12.2; 123/58 B; 417/222, 269

[56] References Cited

U.S. PATENT DOCUMENTS

| | | | |
|---|---|---|---|
| 2,048,272 | 7/1936 | Linthicum | 74/60 |
| 2,256,079 | 9/1941 | Dinzl | 74/60 |
| 2,258,127 | 10/1941 | Almen | 74/60 |
| 2,282,722 | 5/1942 | Hall | 74/60 |
| 2,464,538 | 3/1949 | Venderzee | 192/87.17 |
| 2,718,758 | 9/1955 | Minshall et al. | 192/61 |
| 2,812,664 | 11/1957 | Hopkins | 74/60 |
| 2,917,931 | 12/1959 | Sherman | 92/12.2 |
| 3,139,038 | 6/1964 | Stewart | 74/60 |
| 3,319,874 | 5/1967 | Welsh et al. | 74/60 |
| 3,357,209 | 12/1967 | Mooney | 464/141 |
| 3,584,514 | 6/1971 | Hamma | 74/60 |
| 4,061,443 | 12/1977 | Black et al. | 74/60 |
| 4,073,603 | 2/1978 | Abendschein et al. | 74/60 |
| 4,077,269 | 3/1978 | Hodgkinson | 417/269 |

OTHER PUBLICATIONS

SAE Journal, vol. 47, No. 6, Dec. 1940, pp. 504–519, E. S. Hall, "More Power from Less Engine."

*Primary Examiner*—Leslie A. Braun
*Assistant Examiner*—Joseph M. Rolnicki
*Attorney, Agent, or Firm*—Howard L. Rose

[57] ABSTRACT

The invention relates to wabbler plate engine mechanisms. One such mechanism has a wabbler plate rotatably mounted on a wabbler carrier which is in turn inclinably mounted on a crankshaft in a crankcase. The wabbler plate has a plurality of arms which are coupled to pistons slidably mounted in cylinders arranged around the axis of the crankshaft. As the crankshaft rotates, each arm oscillates laterally relative to its respective piston and a stabilizer mechanism comprising ball races on the wabbler plate and a ball carrier on the crankcase, is included to prevent the oscillations from unbalancing the mechanism. This construction is quite satisfactory but is not readily adaptable to provide for variable displacement. Attempts have been made to incorporate this facility, but a successful solution has not yet been found.

In order to provide a variable displacement facility in an engine mechanism of the above kind, the present invention incorporates means for shifting the rotational axis of the wabbler plate along the axis of the crankshaft, and the ball carrier parallel thereto, while simultaneously altering the angle between the crankshaft axis and the wabbler carrier to vary the stroke of the mechanism. The invention also provides for the effective lengths of the ball races to be variable to accommodate the alternation of said angle.

13 Claims, 5 Drawing Figures

WABBLER PLATE ENGINE MECHANISMS

BACKGROUND TO THE INVENTION

This invention relates to wabbler plate engine mechanisms and has as its aim to introduce a variable displacement facility thereto which is simple in operation and preserves the stability of the mechanism. Such mechanisms are useful in internal and external combustion engines and in pumps.

Wabbler plate engine mechanisms broadly comprise a plurality of piston/cylinders arranged around a crankshaft axis, and coupled to arms of a wabbler plate rotatably mounted on a wabbler carrier, which is obliquely mounted on a crankshaft. As the crankshaft rotates, each piston is forced to reciprocate in its cylinder, and vice versa. These mechanisms are known for example from U.S. Pat. No. 2, 258, 127 to Almen. The mechanism described in that patent resolved a number of problems inherent in wabbler plate mechanisms, particularly that of stabilizing the mechanism while permitting the wabbler plate arms to oscillate relative to each piston in a plane perpendicular to the axis thereof. Almen describes the provision of ball races on curved surfaces of the wabbler plate and crankcase which confine a ball at the intersection thereof. As these races are only in alignment at the top dead centre and bottom dead centre positions of the pistons, the ball can never become displaced. The Almen mechanism is quite satisfactory for fixed displacement but is not adapted to variable displacement.

SUMMARY OF THE INVENTION

The present invention seeks to adapt a wabbler plate engine mechanism generally of the kind disclosed in U.S. Pat. No. 2,258,127. As in this patent, a mechanism according to the invention comprises a crankcase having a crankshaft rotatable therein; a wabbler carrier obliquely mounted on the crankshaft; and a wabbler plate rotatably mounted on the carrier; a plurality of cylinders arranged around the crankshaft with pistons reciprocally moveable therein along axes substantially parallel to the rotational axis of the crankshaft, the wabbler plate having arms extending radially therefrom to bearings coupling each arm to a piston, each bearing permitting lateral movement of the respective arm relative to the axis of the piston; and a stabilizer mechanism operating between the wabbler plate and the crankcase comprising ball races formed in juxtaposed curved surfaces of the wabbler plate and a ball carrier on the crankcase, and a ball confined at the intersection of the ball races. However in addition, means are provided for shifting the rotational axis of the wabbler plate along the axis of the crankshaft, and the ball carrier on the crankcase parallel thereto, while simultaneously altering the angle between the crankshaft axis and the wabbler carrier to vary the stroke of the engine mechanism. Further, the effective lengths of the ball races of the stabilizer mechanism are variable to accommodate the alteration of said angle.

In preferred embodiments of the invention, the crankshaft is slidably coupled to an output shaft, the shifting means being operable to shift the crankshaft relative to the output shaft. To achieve simultaneous alteration of the wabbler carrier angle, the carrier is coupled by a flexible linkage to a connection fixed axially in relation to the crankcase,, the linkage causing alteration of said angle as the shafts are shifted relative to one another.

One such linkage comprises links pivotally mounted on the connection and pivotally coupled to the wabbler carrier at a position eccentrically located with respect to the rotational axis of the crankshaft.

Another such linkage comprises a body integral with the wabbler carrier defining a slot extending substantially parallel to the rotational axis of the wabbler plate on the carrier, the fixed connection slidably engaging the slot to cause alteration of said angle upon relative axial movement of the body and the connection. This arrangement is better suited to larger mechanisms, primarily for the reason that the crankshaft must normally be slotted to permit the connection to be mounted on the output shaft while engaging the slot in the body on the wabbler carrier.

The shifting means may take a number of forms, and various suitable systems are referred to herein. The means may, if desired, be coupled to the output shaft to obviate the need for an auxiliary power source to effect the change, or for purely manual operation. The mechanisms described herein can also be adjusted while they are operating, which is also facilitated by some form of automatic operation.

Provision may also be made in mechanisms according to the invention for altering the wabbler carrier angle independently of any shifting of the wabbler plate axis. This enables the stroke of the mechanism to be adjusted by small amounts, thereby varying the compression ratio within perceptible limits.

The variations afforded by the present invention are of particular value in the field of motor transport where engines are continually being used under different demand conditions. For town driving for example, an engine embodying the invention can be adjusted to minimum displacement, while the effective capacity can be increased for high speed motoring. In this way, optimum fuel economy can be achieved. Adjustment can also be made while a vehicle is in motion, to match the engine to the vehicle road load requirements.

BRIEF DESCRIPTION OF THE DRAWINGS

The invention will now be described by way of example and with reference to the accompanying drawings wherein.

DESCRIPTION OF PREFERRED EMBODIMENTS

In none of the figures of the drawings is a cylinder head assembly illustrated. In each case, this may be of conventional design depending of course upon the purpose; i.e. engine or pump, for which the mechanism is to be used.

Figure 1:
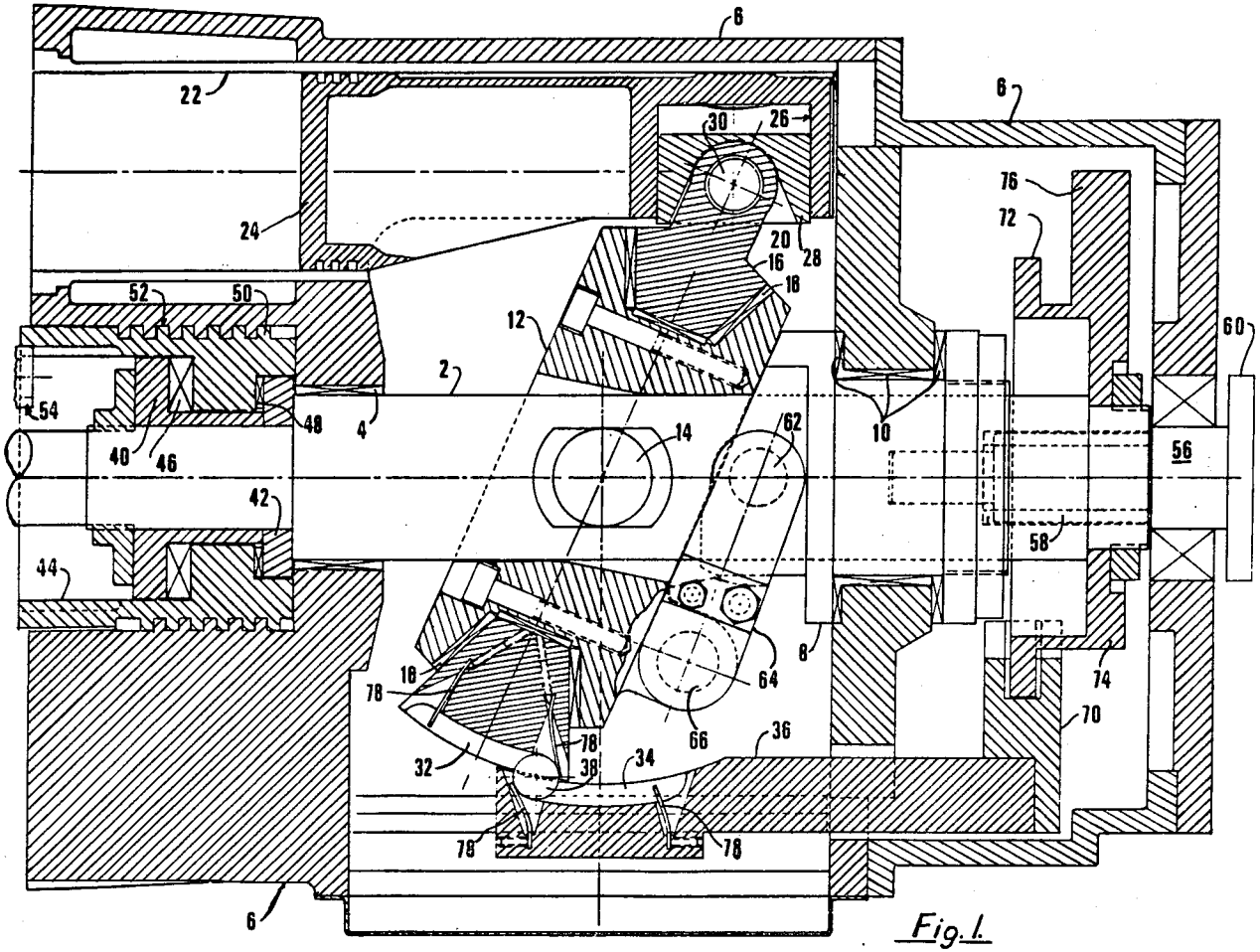
FIG. 1 is a longitudinal cross-section of one embodiment of engine mechanism according to the invention, the piston illustrated being in the bottom dead centre position, and the mechanism being at maximum displacement.
Figure 2:
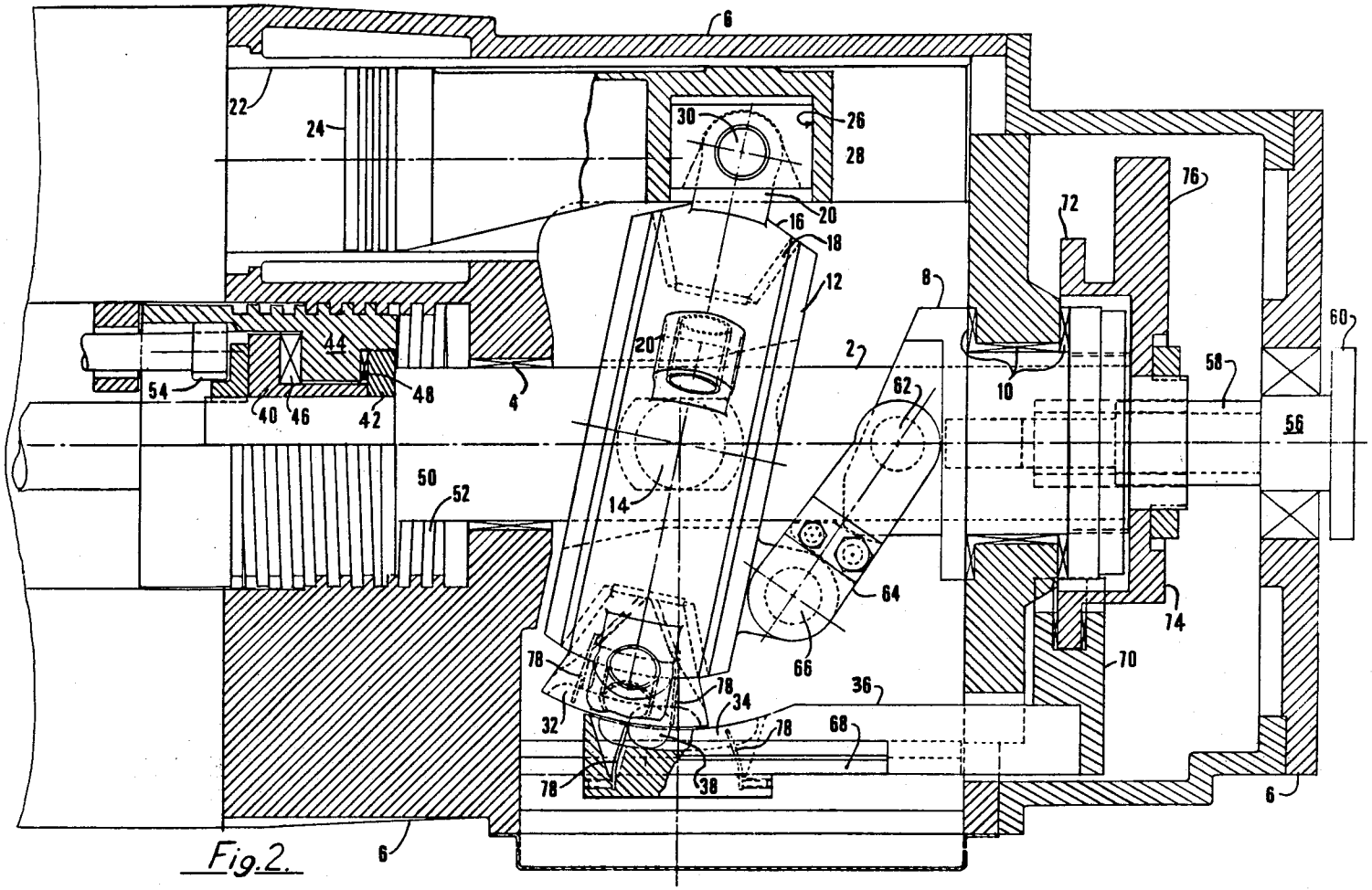
FIG. 2 is a view similar to that of FIG. 1, but showing the mechanism at minimum displacement.
Figure 3:
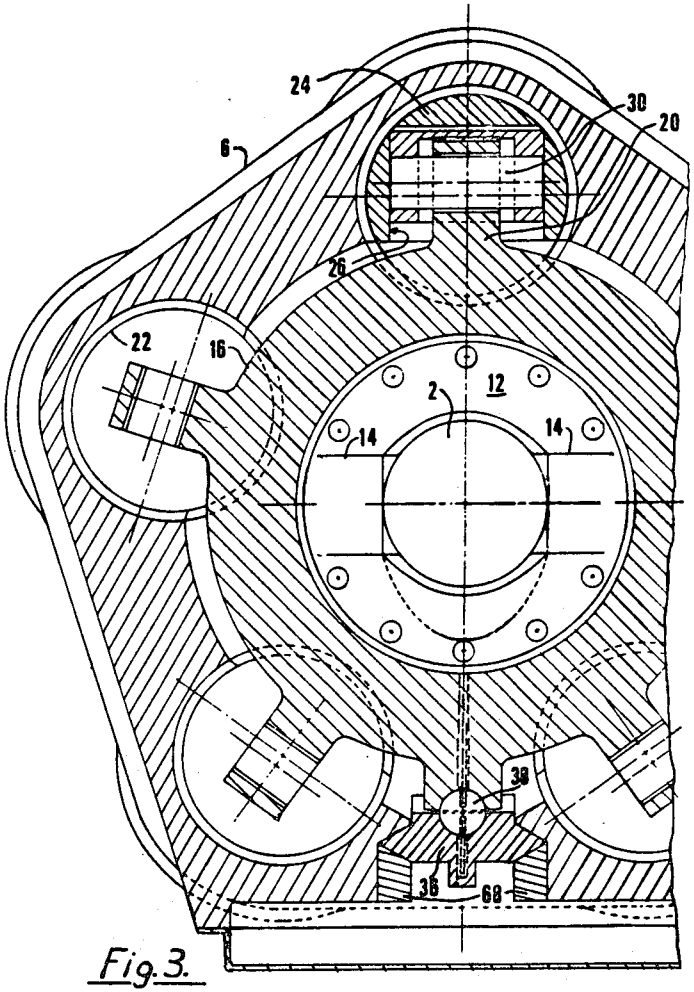
FIG. 3 is a transverse cross-section (but not in a true position) of the mechanism of FIG. 1, showing the main components of the wabbler plate and stabilizer mechanism.

In the engine mechanism of FIGS. 1 to 3, a crankshaft 2 is mounted in bearings 4 on a crankcase 6 and slidably coupled to an anchor member 8. The anchor member is mounted in radial and thrust bearings 10 on the crankcase 6. The crankshaft 2 supports a wabbler carrier 12, pivotally mounted on trunnion pins 14. An annular wabbler plate 16 is mounted in thrust and radial bearings 18 on the carrier 12 and includes a plurality of arms 20 (in this embodiment five) extending radially therefrom. A plurality of cylinders 22 are arranged around the crankshaft 2, with their axes parallel thereto, and a piston 24 is reciprocally movable in each cylinder.

At the bottom of each piston is formed a pocket bore 26 having an open end directed radially inwards towards the crankshaft axis. This bore 26 slidably receives a bearing piston 28 to which an arm 20 is coupled by means of a little end bearing on a wrist pin 30. As the crankshaft 2 (and wabbler carrier 12) rotate, each arm 20 will describe a lemniscate, (a figure of eight on the surface of a sphere) and this movement is accommodated by the radial freedom afforded by the bearing piston 28 in bore 26, and the tangential freedom afforded by the designed end float on wrist pin 30, best shown in FIG. 3.

The bearing piston 28 and wrist pin 30 assembly has the effect of transferring the engine torque reaction equally to all cylinders 22 from pistons 24 and to crankcase 6, with the exception of the frictional torque generated by the bearing surfaces. To counteract this frictional torque, a stabilizer mechanism is included. This mechanism consists of ball races 32, 34 formed in juxtaposed curved surfaces of the wabbler plate 16 and a ball race carrier 36 mounted on the crankcase 6 diametrically opposite one of the arms 20. The race 34 in the ball race carrier 36 and the axis of the crankshaft 2 have a common plane, but the race 34 is concave with respect thereto, defining the arc of a circle with its centre at the intersection of the crankshaft axis and the axis of the trunnion pins 14. The race 32 on the wabbler plate 16 defines a similar arc, but because of the rotation of the crankshaft 2 and wabbler carrier 12, the two races will only be aligned when the engine mechanism is at its top (TDC) or its bottom (BDC) dead centre position. At all other times the races will be mutually inclined and the stabilizer mechanism is completed by a ball 38 confined between the two races 32, 34 where they intersect or, in the extreme positions, overlap.

In order to vary the displacement of the engine mechanism, means are provided for shifting the crankshaft 2 axially with respect to the crankcase 6, and for simultaneously altering the angle between the wabbler carrier 12 and the crankshaft axis. The latter alteration changes the stroke of the pistons 24 while tthe former shifts the oscillatory motion of the pistons 24 such that their respective top dead centre positions are properly located. The shifting means in the embodiment of FIGS. 1 to 3 operates as follows:

The main shaft 2 is slidable axially, with respect to the crankcase 6, in the bearings 4 and in the anchor member 8 in a close sliding fit. Thrust bearing rings 40 and 42 are fixed to the crankcase 2 and are rotatably mounted with respect to a member 44 by means of thrust bearings 46 and 48. The member 44 has an external screw thread 50 which mates with a complementary internal screw thread 52 formed in the crankcase 6. Rotation of the member 44 with respect to the crankcase 6 shifts the crankshaft 2 axially within the engine mechanism. A pinion gear 54 is shown for effecting this movement. Manual, electric, pneumatic or hydraulic mechanisms might be used to achieve this, with or without the use of the pinion gear 54. At its other end, to the right as shown in FIGS. 1 and 2, the crankshaft 2 is splined to an output shaft 56, this splined coupling 58 accommodating the axial shift of the crankshaft 2 without displacing a flange 60 on the output shaft 56 for coupling to, for example, the transmission system of a motor vehicle.

As noted above, the wabbler carrier 12 is pivotally mounted on the crankshaft 2 by trunnion pins 14. For any given axial position of the crankshaft 2, the angle between the wabbler carrier 12 and the crankshaft axis is fixed by a flexible linkage between the wabbler carrier 12 and the anchor member 8 which prevents relative rotation therebetween. The anchor member 8 carries a connection 62 to which a two piece link 64 is pivotally connected at one end. At its other end the link 64 is pivotally connected to a pin 66 mounted on the wabbler carrier 12. An identical linkage will normally be provided on the opposite side of the wabbler carrier 12. When the crankshaft 2 is shifted axially the link 64 alters the angle of the wabbler carrier 12 as shown in FIG. 2. The dimensions of the linkage will be chosen to provide a suitable displacement characteristic for the mechanism.

It will be appreciated that as the crankshaft 2 is shifted axially, so must the ball race carrier 36 to ensure that the centre of curvature of the race 34 remains at the intersection of the trunnion pin 14 and crankshaft 2 axes. To provide this synchronous movement the ball race carrier 36 is slidably mounted in the crankcase 6 on rails 68 and coupled to the crankshaft 2 by a bearing member 70. The bearing member 70 receives the rim 72 of a bearing ring 74 fixed on the crankshaft 2. The bearing ring 74 is part of a counterweight assembly for preserving dynamic balance of the mechanism, which includes a counterweight 76. Thus, the relative axial positions of the crankshaft 2, the ball race carrier 36 and the counterweight are fixed for all displacement settings of the mechanism.

With the alteration of the angle of the wabbler carrier the stroke of each piston 24 is changed, as is the length of the arc required in each of the ball races 32 and 34. This means that, when the races are aligned in the TDC and BDC position, the ball 38 will only be confined when the displacement (or stroke) is at a maximum. At other displacements the ball 38 could move out of position in the races 32 and 34 and cause the mechanism to seize. To prevent this, means are provided to limit the effective length of the races 32 and 34 when the stroke is reduced. As shown in FIGS. 1 to 3 a leaf spring 78 extends into each race 32, 34 to resiliently urge the ball 38 towards the centre of the respective race. Thus for the maximum displacement setting shown in FIG. 1, each leaf spring 78 will be fully extended in the TDC or BDC position, while at minimum displacement, as shown in FIG. 2, only a minimal flexure (if any) of the leaf springs is required in the TDC or BDC positions to prevent the ball 38 from moving to a seizure location in the races 32, 34. As the stabilizing forces are predominantly perpendicular to the plane of the ball race 34 the walls of the races 32, 34 provide the requisite resistance and the leaf springs 78 are not required to exert any force. Accordingly, their stiffness can be very low but the spring rates of diagonally opposed pair of springs must be substantially equal. The springs 78 play a secondary role while the engine is in motion at less than maximum displacement, but they become essential when the engine is stationary and the ball races 32 and 34 are aligned. The stiffness of the springs 78 is a function of the size and weight of ball 38.

Figure 4:
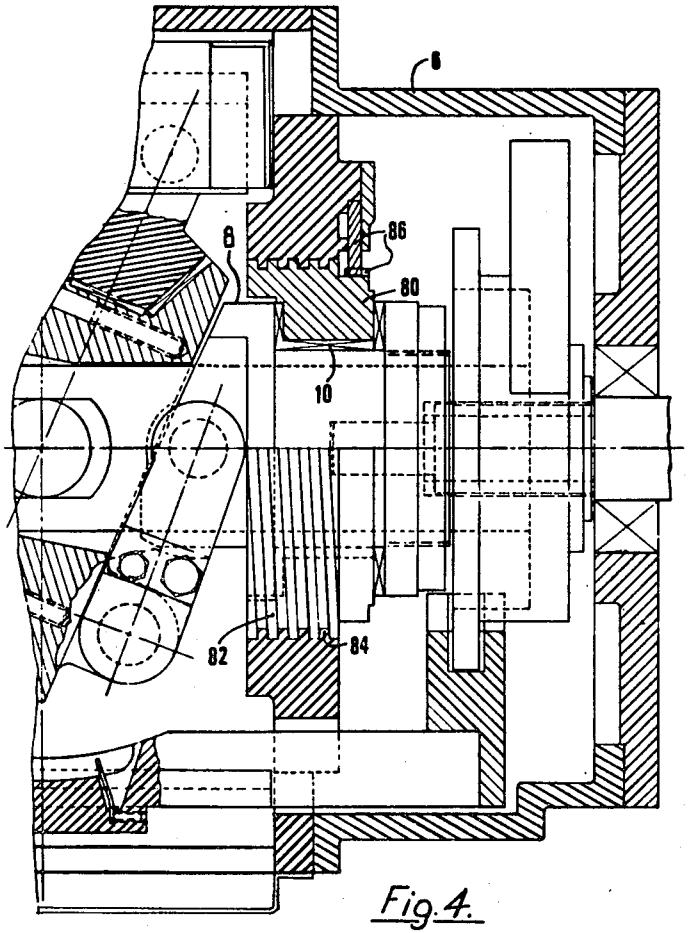
FIG. 4 shows in longitudinal cross-section a portion of a mechanism similar to that of FIG. 1, but incorporating means for independently altering the wabbler carrier angle.

In the modification shown in FIG. 4, provision is made for altering the angle of the wabbler carrier 12 without shifting the crankshaft 2 or alternatively, maintaining the same stroke for the pistons 24 while shifting the crankshaft; i.e., to vary the compression ratio of the mechanism. The anchor member 8 is supported in a member 80 having an external screw thread 82 mating with a complementary internal screw thread 84 in the crankcase 6. A rack and pinion gear 86 operable from outside the mechanism is operable to rotate the member 80 to alter its axial location independently of the crankshaft 2. Other means may be used to shift the member 80 if desired. Axial shifting of the anchor member 8 has the effect of increasing or decreasing the stroke of the mechanism without compensation to the unswept volume (i.e. head volume). For example, if the stroke is slightly increased without changing the position of trunnion pins 14, the unswept volume is decreased by half or additional swept volume, and in combination with the increased swept volume the compression ratio is increased. Decrease of stroke will decrease the compression ratio.

Stabilizer ball races 32 and 34 must be increased in length to accept the additional piston stroke as too must cylinders 22 to accept the additional piston stroke.

Figure 5:
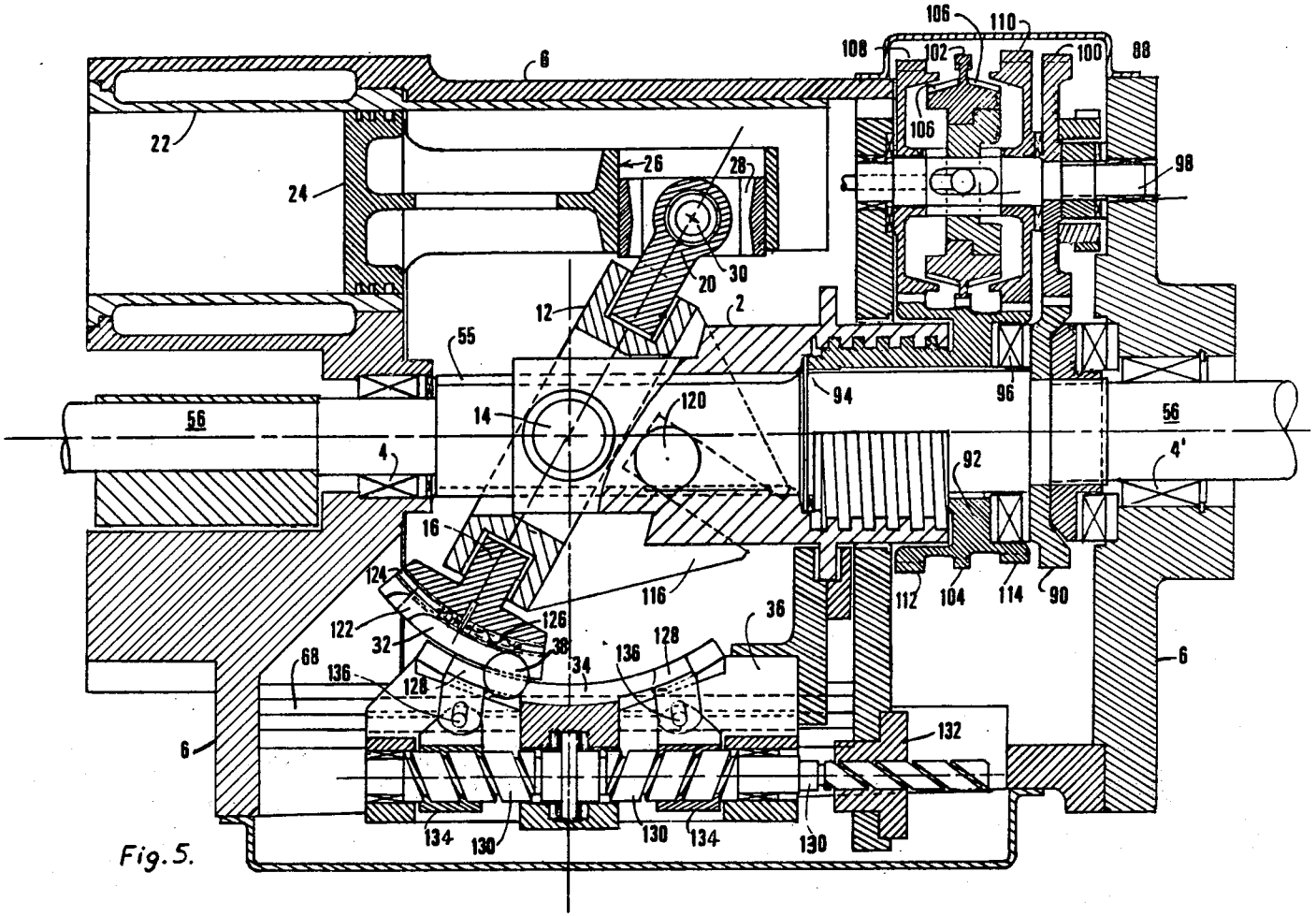
FIG. 5 is a view, similar to that of FIG. 1, of another embodiment of the invention.

In the embodiment of FIG. 5, the mounting of the wabbler carrier 12 and plate 16 on the crankshaft 2, and the coupling of the wabbler plate to the pistons 24 is substantially the same as in the embodiment of FIGS. 1 to 3 and will not be described again. In this embodiment though, the crankshaft 2 is in the form of a cylinder slidably mounted by means of splines 55 on an output shaft 56 that extends the length of the crankcase 6 supported in bearings 4 and 4'. The shifting means for the crankshaft comprises a clutched gearbox 88 driven by a gear 90 fixed on the output shaft 56, and driving a member 92 axially fixed in relation to the crankcase 6 and the output shaft 56 by bearings 94 and 96. The member 92 has an external screw thread mating with a complementary internal screw thread on the crankshaft 2. The gearbox 88 has a layshaft 98 supporting a gear 100 in permanent mesh with the gear 90 and a clutch gear 102 movable axially on the layshaft 98. For any given displacement of the mechanism, the clutch gear 102 is in mesh with a gear 104 on the member 92, the ratio between the gear 100 and the gear 90 being the same as that between the clutch gear 102 and the gear 104, thereby preventing relative rotation between the member 92 and the crankshaft 2 and fixing their relative axial position. To change the displacement, the clutch gear 102 is shifted so that it disengages from the gear 104 and one of the cone clutches 106 mates respectively with one of the gears 108 and 110, normally rotating freely on the layshaft 98, which are in permanent mesh with gears 112 and 114 on the member 92. The gears 108, 110, 112 and 114 are so sized that movement of the clutch gear 102 to the right as shown in the figure causes relative rotation of the member 92 in one sense with respect to the crankshaft 2, and movement of the left in the other. Such relative rotation causes the crankshaft 2 to shift to the left or the right as shown.

In order to simultaneously alter the angle of the wabbler carrier 12 to the crankshaft axis, the carrier 12 has a body 116 fixed thereto with a slot 118 formed therein and extending therefrom in a direction generally perpendicular to the plane of the carrier 12. A pin 120 fixed with respect to the output shaft 56 engages the slot 118, sliding therealong as the crankshaft 2 is shifted, and forcing the angle to change. The position of the slot 118 and pin 120 will be chosen to produce the desired characteristic, and the slot may be non-linear in certain circumstances. A similar arrangement to that shown and described will normally be provided on the opposite side of the wabbler carrier 12.

The stabilizer mechanism in the embodiment of FIG. 5 is similar to that of FIGS. 1 to 3 in that ball races 32 and 34 are provided on the wabbler plate 16 and a ball race carrier 36 but the means for varying the effective length of the races is different. On the wabbler plate 16, the length of race 32 is defined by stops 122 running in guides 124, the stops being continuously urged to the centre of the race by spring 126. Similar means might be employed on the ball race carrier 36, but a more definitive device is employed in this example. The effective length of the race 34 is determined by stops 128, but the position of these stops is determined directly by a mechanical coupling to the movement of the crankshaft 2. As in the embodiment of FIGS. 1 to 3 the ball race carrier 36 moves with the crankshaft, but this movement simultaneously rotates a double threaded shaft 130 through a non-locking screw and nut drive 132. Followers 134 to the shaft 130 drive stops 128 via pins and shaped slots 136 to shorten or lengthen the ball race 34 in accordance with the sense of rotation of the shaft 130.

It will be appreciated that many of the features of each embodiment described could be incorporated in the other, but as a rule, that of FIG. 5 is more easily incorporated to heavy duty mechanisms, for example large capacity engines, while the first embodiment is better suited to more lightweight structures. Each though enables the displacement to be varied while the mechanism is operating, this being of particular advantage for motor vehicle engines where power requirements change frequently, even during normal use.

Mechanisms of the invention also have the ability to be used in tandem, with two or more mechanisms being aligned and coupled to a common output shaft transmission system. In the embodiment of FIG. 5, successive mechanisms may be mounted on a single shaft 56. In the embodiment of FIGS. 1 to 4, successive crankshafts and output shafts can be slidably coupled. The mechanisms may also be coupled in a horizontally opposed arrangement, with cylinders 22 being aligned with their counterparts in another similar mechanism. In an internal combustion engine comprising two such mechanisms, the ignition system would be incorporated between opposed cylinders, and it will be noted that by adapting the means for altering the angle of the wabbler carrier in one mechanism to be capable of making that angle 90°, that mechanism may be rendered inoperative, to provide greater reduction in the displacement ratio.

In the embodiments described, each of the adjustments referred to can be made while the mechanism is operated, and for a motor vehicle, even while the vehicle is in motion. Such an application of the invention permits variation of engine capacity and compression ratio according to demand in a manner which can easily be effected between, for example, town use, motorway driving and acceleration.

I claim:

1. A wabbler plate engine mechanism comprising a crankcase having a crankshaft rotatable therein, the crankshaft being slidably coupled to an output shaft; a wabbler carrier obliquely mounted on the crankshaft and coupled by a flexible linkage to a connection fixed axially in relation to the crankcase, the linkage causing alteration of the angle between the crankshaft axis and the wabbler carrier, and thereby the stroke of the mechanism as the crankshaft is shifted relative to the output shaft; and a wabbler plate rotatably mounted on the carrier; a plurality of cylinders arranged around the crankshaft with pistons reciprocally moveable therein along axes substantially parallel to the rotational axis of the crankshaft; the wabbler plate having arms extending radially therefrom to bearings coupling each arm to a piston, each bearing permitting lateral movement of the respective arm relative to the axis of the piston; a stabilizer mechanism operating between the wabbler plate and the crankcase comprising ball races formed in juxtaposed curved surfaces of the wabbler plate and a ball race carrier on the crankcase, and a ball confined at the intersection of the ball races; and means comprising a screw threaded member mating with a corresponding thread in the crankcase around the crankshaft axis and coupled to the crankshaft and operable to shift the crankshaft axially and thereby the rotational axis of the wabbler plate, the crankshaft being connected to the ball race carrier on the crankcase such that the center of the carrier is always perpendicularly aligned with the rotational axis of the wabbler plate, the effective lengths of the ball races of the stabilizer being variable to accommodate such alteration of the angle between the crankshaft axis and the wabbler carrier.

2. A wabbler plate engine mechanism comprising: a crankcase having a crankshaft rotatable therein; a wabbler carrier obliquely mounted on the crankshaft; and a wabbler plate rotatably mounted on the carrier; a plurality of cylinders arranged around the crankshaft with pistons reciprocally moveable therein along axes substantially parallel to the rotational axis of the crankshaft, the wabbler plate having arms extending radially therefrom to bearings coupling each arm to a piston each bearing permitting lateral movement of the respective arm relative to the axis of the piston; a stabilizer mechanism operating between the wabbler plate and the crankcase comprising ball races formed in juxtaposed curved surfaces of the wabbler plate and a ball race carrier on the crankcase, and a ball confined at the intersection of the ball races; and means for shifting the rotational axis of the wabbler plate along the axis of the crankshaft and for shifting the ball race carrier on the crankcase along a line parallel to said crankshaft axis, while simultaneously altering the angle between the crankshaft axis and the wabbler carrier to vary the stroke of the engine mechanism, and wherein the effective lengths of the ball races of the stabilizer are variable to accommodate the alteration of said angle.

3. An engine mechanism according to claim 2 wherein the crankshaft is slidably coupled to an output shaft; wherein the shifting means are operable to shift the crankshaft relative to the output shaft; and wherein the wabbler carrier is coupled by a flexible linkage to a connection fixed axially in relation to the crankcase, the linkage causing alteration of said angle as the shafts are shifted relative to one another.

4. An engine mechanism according to claim 3 wherein the linkage comprises links pivotally mounted on the connection and pivotally coupled to the wabbler carrier at a position eccentrically located with respect to the rotational axis of the crankshaft.

5. An engine mechanism according to claim 1 including means for altering the angle between the crankshaft axis and the wabbler carrier, without axially shifting the rotational axis of the wabbler plate along the axis of the crankshaft, to vary the stroke of the mechanism.

6. An engine mechanism according to claim 3 wherein the linkage comprises a body integral with the wabbler carrier defining a slot, extending substantially parallel to the rotational axis of the wabbler plate on the carrier, the fixed connection slidably engaging the slot to cause alteration of said angle upon relative axial movement of the body and the connection.

7. An engine mechanism according to claim 1 wherein the shifting means comprises a screw threaded member mating with a corresponding thread in the crankcase around the crankshaft axis and coupled to the crankshaft; and means for rotating the member to shift the crankshaft relative to the crankcase.

8. An engine mechanism according to claim 1 wherein the crankshaft is slidably coupled to an output shaft, and wherein the shifting means comprises a rotatable screw threaded portion fixed on the crankshaft and mating with a corresponding thread in a rotatable auxiliary member coaxial with the output shaft but fixed axially relative to the output shaft, means being provided for imparting relative relation to the crankshaft and auxiliary member to cause relative axial movement of the crankshaft, with respect to the output shaft, the rotating means being selectively operable from rotation of the output shaft.

9. An engine mechanism according to claim 8 wherein the rotating means comprises a clutched gear mechanism coupled between the output shaft and the auxiliary member.

10. An engine mechanism according to claim 1 wherein the ball races of the stabilizer mechanism are defined by grooves in the respective surfaces, and wherein resilient means are provided at either end of each groove for inhibiting free movement of the ball along the races when the races are aligned.

11. An engine mechanism according to claim 10 wherein the resilient means comprise leaf springs.

12. An engine mechanism according to claim 1 wherein the ball races of the stabilizer mechanism are defined by grooves in the respective surfaces, wherein the effective length of the groove in the ball races is defined by stops movably mounted in the groove, and wherein a mechanical linkage is provided between the stops and the crankshaft to move the stops synchronously with variation of the displacement of the engine mechanism.

13. An engine mechanism according to claim 4 including means for altering the angle between the crankshaft axis and the wabbler carrier, without axially shifting the rotational axis of the wabbler plate along the axis of the crankshaft, to vary the stroke of the mechanism, and wherein the altering means comprises a screw threaded element supporting the connection and mating with a corresponding thread in the crankcase; and means for rotating the element to shift the connection axially with respect to the crankshaft.

* * * * *